US006894218B2

(12) United States Patent
Kohn et al.

(10) Patent No.: US 6,894,218 B2
(45) Date of Patent: May 17, 2005

(54) CABLE TAPE AND METHOD FOR MANUFACTURING A CABLE TAPE

(75) Inventors: Frederik Emiel Kohn, Veenendaal (NL); Peter Hubertus Lamers, Veenendaal (NL)

(73) Assignee: Lantor B.V., Veenendaal (NL)

( * ) Notice: Subject to any disclaimer, the term of this patent is extended or adjusted under 35 U.S.C. 154(b) by 0 days.

(21) Appl. No.: 10/240,442

(22) PCT Filed: Apr. 3, 2001

(86) PCT No.: PCT/NL01/00275

§ 371 (c)(1),
(2), (4) Date: Oct. 24, 2002

(87) PCT Pub. No.: WO01/75906

PCT Pub. Date: Oct. 11, 2001

(65) Prior Publication Data

US 2003/0041473 A1 Mar. 6, 2003

(30) Foreign Application Priority Data

Apr. 3, 2000 (NL) ..... 1014829

(51) Int. Cl.[7] ..... H01B 7/34
(52) U.S. Cl. ..... 174/36
(58) Field of Search ..... 174/36, 110 R, 174/110 PM, 110 N, 110 D, 110 V, 110 FC; 57/210, 243; 87/29.6; 139/383 R, 404, 408, 409, 420 R, 421, 426 TW, 420 A; 428/36.9, 39.92, 34.1–34.5, 36.7–36.8; 442/301

(56) References Cited

U.S. PATENT DOCUMENTS

| | | | | | |
|---|---|---|---|---|---|
| 4,108,806 | A | * | 8/1978 | Cohrs et al. | 521/54 |
| 4,118,531 | A | * | 10/1978 | Hauser | 442/344 |
| 4,273,806 | A | * | 6/1981 | Stechler | 427/119 |
| 4,735,833 | A | * | 4/1988 | Chiotis et al. | 428/34.5 |
| 5,089,329 | A | | 2/1992 | de Vrieze et al. | |
| 5,110,998 | A | * | 5/1992 | Muschiatti | 174/24 |
| 5,115,103 | A | * | 5/1992 | Yamanishi et al. | 174/24 |
| 5,128,175 | A | * | 7/1992 | Yamanishi et al. | 427/515 |
| 5,155,138 | A | * | 10/1992 | Lundqvist | 521/76 |
| 5,209,967 | A | * | 5/1993 | Wright et al. | 428/317.9 |
| 5,750,931 | A | * | 5/1998 | McGregor et al. | 174/110 PM |
| 6,262,161 | B1 | * | 7/2001 | Betso et al. | 524/425 |
| 6,410,137 | B1 | * | 6/2002 | Bunyan | 428/356 |

FOREIGN PATENT DOCUMENTS

| | | | | |
|---|---|---|---|---|
| DE | 3048912 | A1 | 12/1980 | |
| DE | 3409364 | | 9/1985 | |
| DE | 3511594 | A1 | 2/1986 | |
| EP | 0151900 | B1 | 12/1984 | |
| EP | 0155430 | A1 | 12/1984 | |
| EP | 0 271 171 | A1 * | 6/1988 | H01B/7/28 |

* cited by examiner

*Primary Examiner*—William H. Mayo, III
(74) *Attorney, Agent, or Firm*—Welsh & Katz, Ltd.

(57) ABSTRACT

The invention relates to a cable tape, based on at least one fibrous web, in which fibrous web at least 0.5% by weight, calculated on the weight of the cable tape, of thermoplastic microspheres which may or may not be partly or wholly expanded and, if desired, an effective amount of a water-swelling powder is incorporated, and to a method for the manufacture of such a tape and to cable manufactured using the tape.

15 Claims, 4 Drawing Sheets

CABLE TAPE AND METHOD FOR MANUFACTURING A CABLE TAPE

The invention relates to a cable tape, based on a fibrous web, as well as to a method for manufacturing such a cable tape and to cables in which such a cable tape is incorporated.

When manufacturing cables, for instance telecommunication cables, industrial (flexible) cables or energy cables (medium, high and ultra high voltage), a cable tape is often provided between the core or vein and the sheath, together, or not, with one or more other layers, for instance the copper wire screen in an energy cable. The function of this tape is often twofold, on the one hand to provide longitudinal watertightness and on the other hand to fill up empty spaces in the cable, so that this tape can serve as a bedding for an overlying layer, such as the copper wire screen in an energy cable.

The longitudinal watertightness is obtained by incorporating a water-swelling material, swelling powder, into the tape, while the filling properties are often obtained with a thick tape, obtainable, inter alia, by providing a foam or foamy structure; more bedding, also called cushioning.

The current types of cable tape for these applications are nearly always manufactured by uniting two layers of basic web, a layer of swelling powder being provided between the two layers. To obtain the filling effect, often an additional, third layer of base web, or, an alternative to the covering web, a layer of foam is often applied by lamination. Owing to this large number of operations, the cost price of the material is, as a rule, prohibitively high for these applications.

From EP-A-0 271 171, a cable tape is known consisting of a carrier material in which or on which thermally expandable microcapsules are provided. This known cable tape has a high content of microcapsules (typically more than 20% by weight) and, preferably different types of microcapsules are used. For this reason, also, several process steps are necessary for expanding such a cable tape, which is disadvantageous.

Further, from the German Offenlegungsschrift 30 48 912, a petrolate composition for use in energy cables is known which composition comprises microcapsules. According to this publication, the cable is filled with the petrolate composition and, subsequently, the cable is subjected to conditions wherein the microcapsules expand. This method is also laborious and requires several process steps. Moreover, according to this publication, the microcapsules are used to influence the dielectric constant of the petrolate and not to improve the longitudinal watertightness.

Accordingly, it is one of the objects of the invention to provide a cable tape which is simple to produce and, in addition to filling properties, can also have swelling properties.

In a first embodiment, the invention concerns a cable tape, based on at least one fibrous web, in which fibrous web at least 0.5% by weight, calculated on the weight of the cable tape, of thermoplastic microspheres and, if desired, an effective amount of water-swelling material is incorporated.

Surprisingly, it has appeared that such a cable tape, where the microspheres are present in the web instead of substantially only on its surface, is simple to produce in one step, while its quality is at least as good, if not better, than the current products which are manufactured in a number of separate steps from a number of discrete layers. The swelling powder that is preferably present can be present in and/or on the web, while the same advantages with respect to the simplicity of manufacture and the quality of the cable tape are obtained.

Surprisingly, it has also appeared that in the presence of swelling powder in and/or on the web, the microspheres in the web considerably increase the swelling properties of the web in water, in particular its swelling rate. The swelling properties, especially the swelling rate, are particularly favourably influenced if at least a part of the swelling powder is present on the web.

In a further embodiment, the cable tape according to the invention is characterized in that it is obtainable by manufacturing an unbound base web providing a binding agent in the web, and binding the web by drying and curing of the binding agent, while the non-expanded, thermoplastic microspheres and, if desired, the water-swelling powder, are incorporated in and/or on the basic web at any moment prior to the drying or prior to the drying and curing of the binding agent, and the microspheres are expanded during or after the drying or during or after the drying and curing of the binding agent.

The invention also relates to a method for manufacturing the cable tape, by manufacturing a base web, providing a binding agent in the web, and binding the web by drying and curing the binding agent, while the water-swelling powder and non-expanded thermoplastic microspheres, at any moment prior to the drying, or prior to the drying and curing of the binding agent, are incorporated in the base web, and, during or after drying, or during of after drying and curing of the binding agent, the microspheres are expanded.

It is particularly surprising that this, web can be manufactured in such a simple manner, while, to the present day, in practice, always multi-step processes were used, with their inherent problems.

The cable tape according to the invention, in its simplest form, is built up from two or three components. The base web, which is the starting point, is a standard base web, originating from a carding machine or spunbond machine for manufacturing non-woven webs. A woven can also be used.

The fibres of the base web are selected from natural fibres and synthetic fibres or a combination thereof. More in particular, polyester fibres, polypropene fibres, acrylic fibres, glass fibres, carbon fibres, polyamide fibres, aramid fibres and mixtures of two or more of these types of fibres are used. The weight of the base web can vary within broad limits, depending on the application. Current weights are from 10 g/m$^2$ to 250 g/m$^2$, preferably from 25 to 100 g/m$^2$. During manufacture, the web is bound with a binding agent, which, after drying or after drying and curing, gives the structure to the tape. Current binding agents are polyacrylates, styrene-butadiene rubbers, vinyl acetate, homo and copolymers and polyvinyl-alcohol.

The expanded thermoplastic microspheres form the second group and consist of a thermoplastic skin, containing a gas. These microspheres are obtained by heating non-expanded spheres, provided with a blowing agent, to the correct temperature whereupon they expand. Such microspheres are, inter alia, commercially available under the name Expancel™ of Akzo Nobel. The thermoplastic polymer of which the cover consists can be based on methyl methacrylate and acrylonitrile, or on methyl methacrylate, acrylonitrile and vinylidene chloride. As a blowing agent, an organic material, such as an aliphatic hydrocarbon gas, for instance isobutane, pentane or iso-octane, is provided in the microspheres. The diameter and the amount of microspheres together with the thickness determine to a large extent the filling properties (bedding properties) of the tape. The tape has a thickness of preferably 0.2 to 5 mm, more in particular 0.25 to 3 mm. The amount of microspheres is at least 0.5% by weight and at most 40% by weight. Preferably, this amount is, between 5 and 25% by weight, most preferably between 10 and 20% by weight.

The microspheres are preferably added to the standard binder formulation together with special auxiliary agents, which provides for the non-expanded spheres to be and to remain homogeneously distributed in the impregnated web.

Upon heating of the microspheres, from the interior of the web, the fibrous structure will also deform (become thicker) and thus obtain its "cushioning" properties (thickness, volume and, most of all, resilient or bedding properties).

The third component is a water-swelling powder, also called "super absorber". These materials are already commonly used in cable tape, and therefore do not need further elucidation.

The swelling powder is preferably strewn on top of the web and covers the top layer; the binder on the surface will serve as an adhesive medium.

It has appeared that swelling powder in and/or on the web, together with microspheres in the web, gives considerably better swelling properties, in particular a higher swelling rate, to the web, than when there are no microspheres in the web.

Apart from these main components, the web optionally contains other auxiliary substances, such as conductive materials (for instance metal particles), shielding or low-conductive materials (for instance soot). In particular for the manufacture of conductive, shielding or low-conductive tapes, it is desired to incorporate this sort of components. This effect can also be obtained by providing conductive fibres in the web in a suitable manner.

The invention also relates to a cable, more in particular a telecommunication cable, industrial (flexible) cable and energy cable (medium high and ultra high voltage), manufactured using the cable tape according to the invention.

The cable tape is manufactured with the aid of conventional equipment, which only needs to be adapted for providing the microspheres and the swelling powder.

CONCISE DESCRIPTION OF THE DRAWINGS

In the appended figures, a number of possibilities for this manufacture are given. These are examples of possible embodiments, without, however, being limited thereto.

DETAILED DESCRIPTION OF THE DRAWINGS

Figure 1:
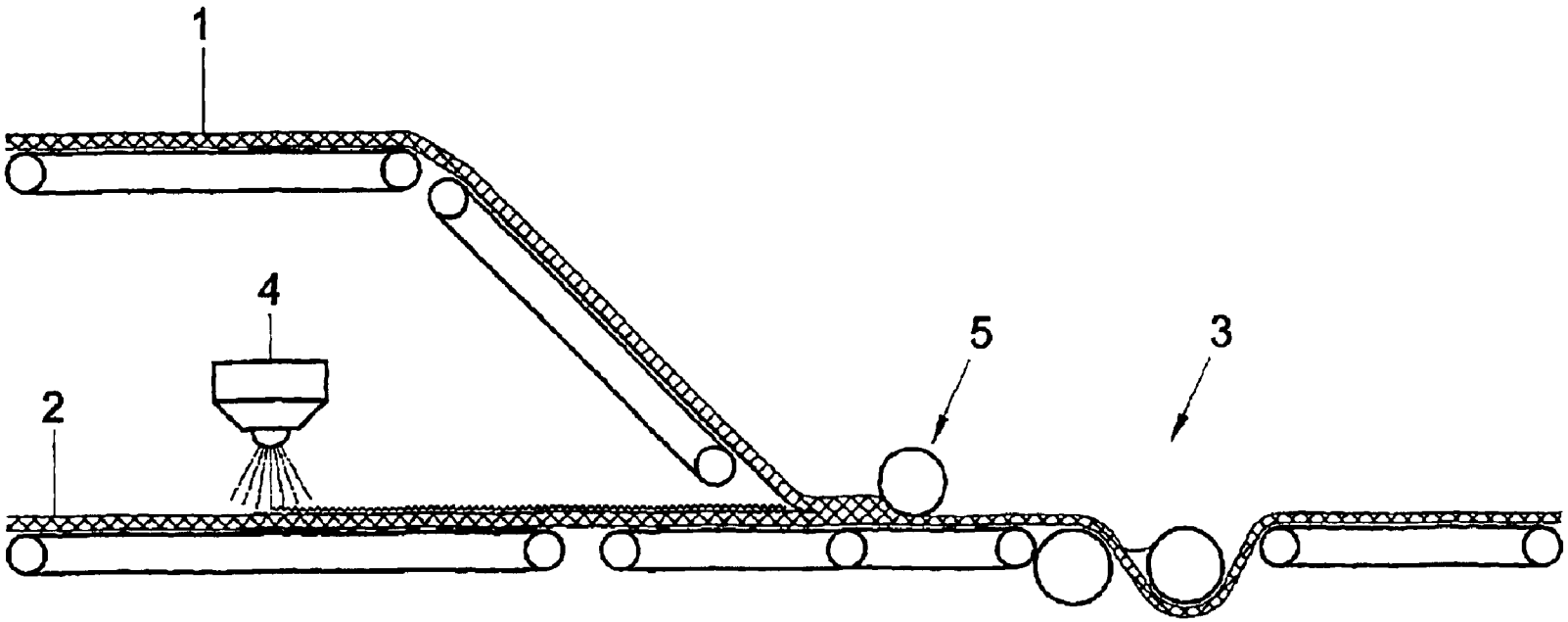
FIG. 1 is a plan view of a carding apparatus of the subject invention.
Figure 2:
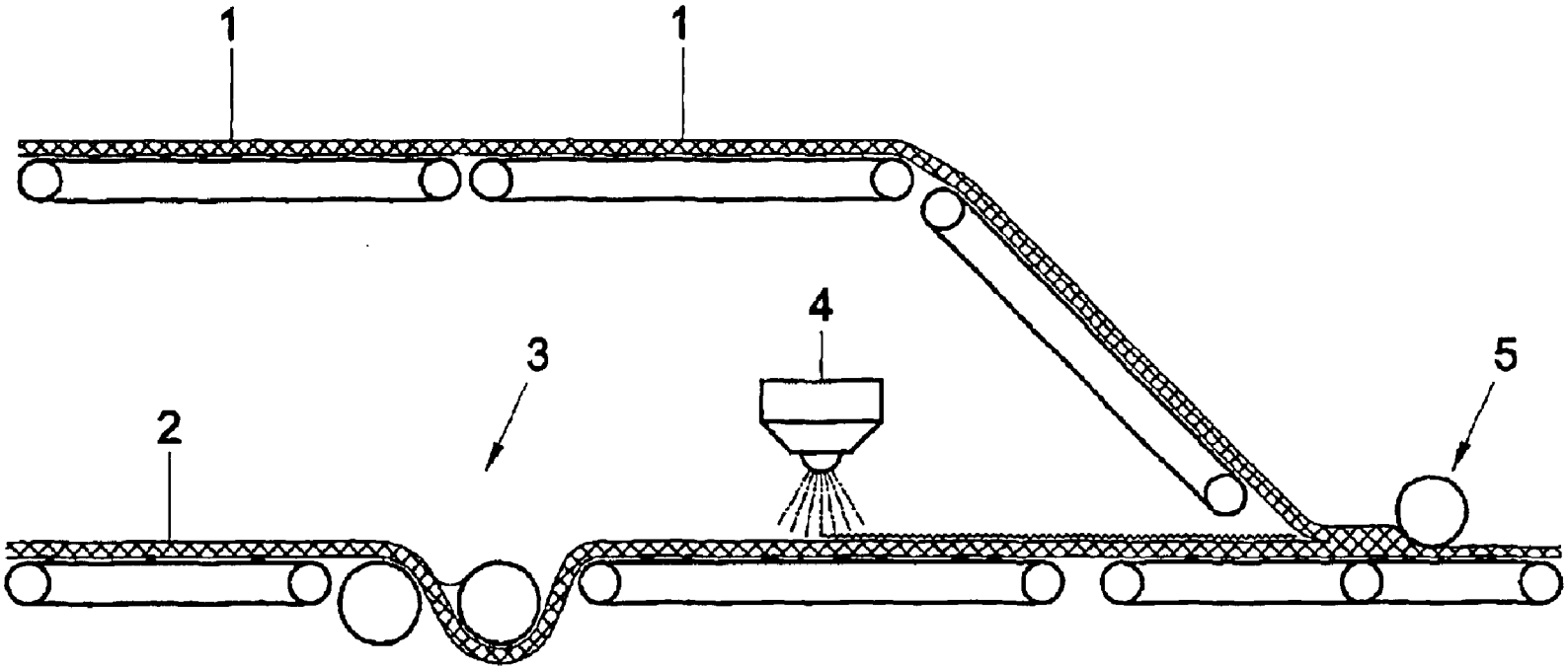
FIG. 2 is a plan view of a second embodiment of the subject invention.
Figure 3:
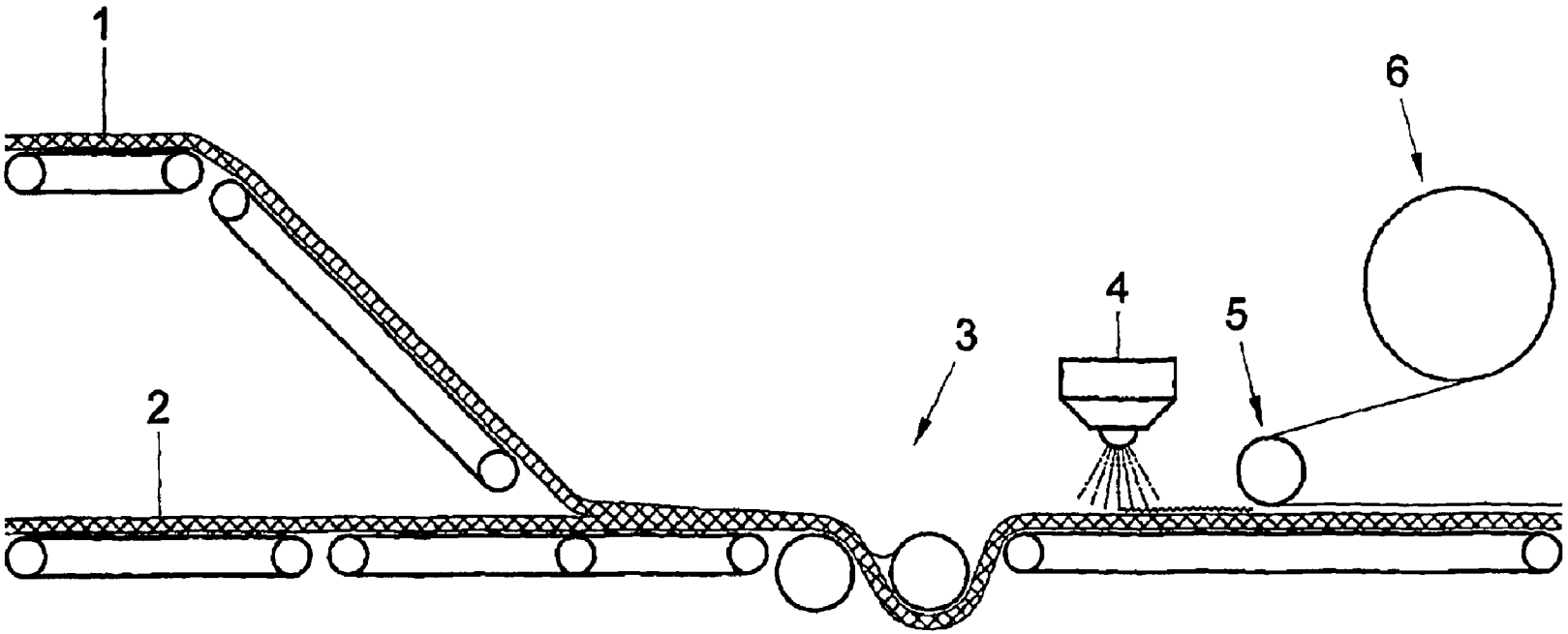
FIG. 3 is a plan view of a third embodiment of the subject invention.
Figure 4:
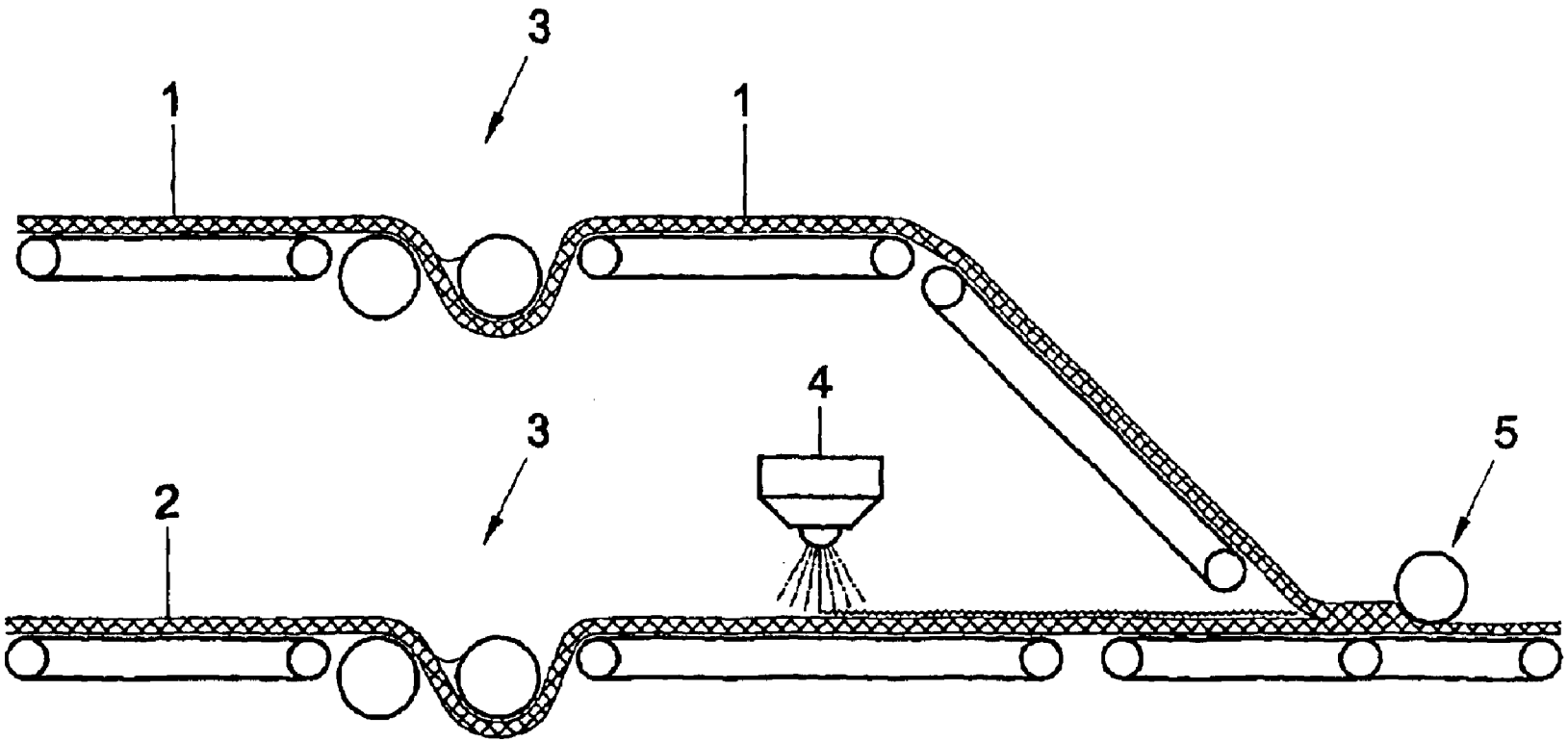
FIG. 4 is a plan view of a fourth embodiment of the subject invention.

All variants shown are based on a conventional carding machine which produces as carding webs or unbound base webs an upper web 1 and a lower web 2, which are pressed and united at 5. Each web separately, or the assembly of upper and lower web, is subsequently provided through a foam foulard 3, with binding agent, in which the not yet expanded microspheres are dispersed, after which the web is dried in a dryer (not shown) or dried and cured.

In the first method, the swelling powder is strewn on the lower web at 4.

With this method, the microspheres are incorporated in the web through the binding agent, while the swelling powder particles are bound in and on the single web with the binding agent. In or after the dryer, the microspheres expand. Depending on the desired form of delivery, the web is subsequently delivered at full machine width or cut to the desired width, which is typically between 5 mm and 200 mm. It is also possible for this cutting to take place subsequently at the cable manufacturers'.

In a second method, the lower web is first bound in the foulard with binding agent, after which the powder is strewn onto it, followed by uniting with the upper web 1 and pressing together 5. The remainder of the treatment is as described hereinabove for methods.

According to a third method, powder is only strewn onto the web after the foulard 3, optionally followed by pressing-on and, optionally, applying a thin covering web 6.

In the fourth variant, the upper web 1 as well as the lower web 2 are separately bound with foulards 3, after which the lower web 2 is strewn with the powder, united and pressed at 5 and further processed as in the first method.

With all methods, after the drying, or after the drying and curing, optionally, calendering can take place, while for special variants, the cable tape obtained in one step can be further treated, for instance by combining two layers, combining with another web, adding a fabric inlay, a surface treatment and the like.

The invention will presently be elucidated in and by two examples.

EXAMPLE 1

A fibrous web consisting of a polyester fibre with a weight of 27 g/m$^2$ was impregnated by means of a foam foulard with 20 g/m$^2$ of a polyacrylate binder dispersion, to which non-expanded microspheres (Expancel™ 007, Akzo Nobel, with a particle size of 14 $\mu$m) had been added. For the dispersion, this gave a distribution of 15 g/m$^2$ binder and 5 g/m$^2$ microspheres.

Directly after impregnation, an amount of 25 g/m$^2$ swelling powder was strewn onto the still wet web. Subsequently, the web was dried at 130° C., whereby, on the one hand, the binding agent cured and, on the other hand, the microspheres expanded. The thickness of the web increased from 0.45 mm to 1.2 mm, which demonstrates that with microspheres in the web, a cable tape with a low weight (47 g/m$^2$) still obtains a much higher thickness (270% higher) and bedding, without a foam layer being necessary.

EXAMPLE 2

A fibrous web consisting of a polyester fibre with a weight of 22 g/m$^2$ was impregnated by means of a foam foulard with 22 g/m$^2$ of a polyacrylate binder dispersion, to which a low percentage of non-expanded microspheres, of the type Expancel™ 007 of Akzo-Nobel, had been added: 95% by weight of binder and 5% by weight of microspheres. Directly after impregnation, an amount of 15 g/m$^2$ swelling powder was strewn onto the wet web. Subsequently, the web was dried at 130° C., whereby, on the one hand, the web was dried, or dried and cured, and, on the other hand, the microspheres expanded. Thereupon, the web was calendered with the swelling powder to a thickness of approximately 0.30 mm. In comparison to the situation without microspheres, it appeared that, by adding a low percentage thereof, the swelling height in the first minute increases from less than 60% to over 80% of the maximum swelling height.

What is claimed is:

1. A cable tape, based on at least one fibrous web, the fibrous web consisting essentially of a fibrous web with at least 0.5% by weight to about 20% by weight, calculated on the weight of the cable tape, of expanded thermoplastic microspheres incorporated within the web, and an effective amount of water-swelling powder.

2. A cable tape according to claim 1, obtainable by manufacturing a base web, providing a binding agent in the web, and binding the web by drying or by drying and curing of the binding agent, wherein a plurality of non-expanded, thermoplastic microspheres are incorporated in the basic web at any moment prior to the drying or prior to the drying and curing of the binding agent, and the microspheres are expanded during or after drying, or during or after drying and curing of the binding agent.

3. A cable tape according to claim 2, wherein the average diameter of the plurality of non-expanded thermoplastic microspheres is between 10 and 100 $\mu$m.

4. A method for manufacturing a cable tape according to claim 2, comprising manufacturing a base web, providing a binding agent in the web, and binding the web by drying or by drying and curing of the binding agent, wherein the water-swelling powder and the plurality of non-expanded, thermoplastic microspheres are incorporated in the basic web at any moment prior to the drying or prior to the drying and curing of the binding agent, and the microspheres are expanded during or after drying or during or after drying and curing of the binding agent.

5. A method according to claim 4, wherein the plurality of non-expanded, or the expanded thermoplastic microspheres are dispersed in the binding agent and are incorporated in the basic web together with the binding agent.

6. A method according to claim 4, wherein the drying, or the drying and curing takes place at a temperature of 100 to 250° C., preferably of 120 to 160° C., and the expansion of the microspheres takes place at a temperature of 75 to 200° C.

7. A cable tape according to claim 1, which has a thickness of 0.2 to 5 mm.

8. A cable tape according to claim 1, which has a width of 2 to 4000 mm.

9. A cable tape according to claim 1, wherein the fibres of the fibrous web are selected from the group consisting of natural and synthetic fibres, more in particular polyester fibres, polypropylene fibres, acrylic fibres, glass fibres, carbon fibres, polyamide fibres, aramid fibres and mixtures of two or more of these types of fibres.

10. A cable tape according to claim 1, wherein the web has filling properties and bedding properties.

11. A cable tape according to claim 1, wherein the tape is suitable for use in telecommunication cable, industrial (flexible) cable and/or energy cable (medium, high and ultrahigh voltage).

12. A cable tape according to claim 1, wherein the web is insulating, low-conductive or conductive.

13. A cable comprising at least one core or vein, a cable tape and a sheath, wherein as cable tape, a cable tape according to claim 1 is used.

14. A cable according to claim 13, in the form of a telecommunication cable, industrial cable or an energy cable.

15. The cable tape of claim 1, wherein the water-swelling powder is incorporated in the basic web at any moment prior to the drying or prior to the drying and curing of the binding agent, and the microspheres are expanded during or after drying, or during or after drying and curing of the binding agent.

* * * * *